US006151738A

United States Patent [19]

Arr

[11] Patent Number: 6,151,738

[45] Date of Patent: Nov. 28, 2000

[54] BAD EXTENSION BACKREST CHEST

[76] Inventor: Dane Michael Arr, 1863 E. Magdalena Dr., Tempe, Ariz. 85283

[21] Appl. No.: 09/090,201

[22] Filed: Jun. 1, 1998

[51] Int. Cl.[7] ..... A47C 31/00; A47C 21/02; A47B 83/00

[52] U.S. Cl. ..... 5/661; 5/633; 5/2.1; 312/237

[58] Field of Search ..... 5/661, 2.1, 633, 5/634; 312/237

[56] References Cited

U.S. PATENT DOCUMENTS

| | | | |
|---|---|---|---|
| 2,721,336 | 10/1955 | Becker | 5/661 |
| 3,335,432 | 8/1967 | Foster | 5/661 |
| 4,937,905 | 7/1990 | Thaxton, Jr. | 5/661 |

FOREIGN PATENT DOCUMENTS

| | | | |
|---|---|---|---|
| 1529416 | 9/1969 | Germany | 5/2.1 |

*Primary Examiner*—Alexander Grosz

[57] ABSTRACT

An adjustable height storage chest with integrated cushioned backrest, which is used to extend the sleeping surface of a bed using connectors to secure it between the bed frame and headboard. Adjustable height is enabled by use of corner mounted legs, which can be positioned at a range of elevations using screw fasteners. The backrest is attached to a frame which is then connected to the chest to create a double-hung door for the chest which allows easy access to the storage area and an adjustable position backrest. Easy use of the backrest is afforded by a soft lift strap with and integrated release pull knob allowing single-handed raising and lowering of the backrest.

1 Claim, 2 Drawing Sheets

BAD EXTENSION BACKREST CHEST

A list of patents disclosing various body supporting furniture items are listed below:

| Patent | Inventor | Issued | Title |
|---|---|---|---|
| 2721336 | Becker | 10/25/55 | Combination extendible crib and chifforobe |
| 3335432 | R. Foster | 8/15/67 | Bed Assembly |
| 1529416 (Ger) | Auping | 9/11/69 | Bed frame with extension for receiving furniture |
| 3596297 | James | 8/1971 | Modular furniture |
| 3950796 | Hollingsworth | 4/1976 | Article of furniture |
| 4109328 | Mason | 8/1978 | Modular furniture system |
| 4185342 | Young | 1/1980 | Portable, adjustable back-rest for beds and the like |
| 3931653 | Bien | 1/1976 | Power operated back rest |
| 3781928 | Swallert | 1/1974 | Device for raising the head end and/or foot end of a bed |
| 4232411 | Speyer | 11/1980 | Combination bed and lounge assembly |
| D252358 | Fowler | 7/1979 | Combined bedstead, mattress and storage unit |
| 4109328 | Mason | 8/1978 | Modular furniture system |
| 4672696 | Horenkamp | 6/1987 | Convertible sitting/reclining furniture article |
| 4937905 | Thaxton | 7/3/90 | Bed Extender |

BACKGROUND OF THE INVENTION

Beds Are Too Short

Mattress style beds with headboards are too short to allow people above the average height (5'8") to extend their arms in line with their back, an act important for the relaxation of many of the body's muscles. The largest of the "standard" sizes, the California king size, provides only fourteen inches more than required for support of the body, assuming that the person is positioned with their ankles at the edge of the bed. For instance, many people are restless sleepers who stretch out in their sleep, often moving to the diagonal and forcing their mate into a small corner of the bed.

The obvious answer to the short bed problem is a longer bed, but the cost of a custom mattress and box spring is substantially more than a standard and requires a custom bedstead as well as custom sheets and bedspread. The expense is unjustifiable to most consumers who would like a longer bed.

The need for an extended sleeping surface has not, by itself, provided the motivation for most consumers with this need to demand or seek a solution. The expense of a custom mattress and associated custom accessories mentioned above is one reason. Another is that no answer to this problem has been presented which fulfills the consumers value-added expectations, in effect, a product that is worth the time, money and effort involved in changing an intimate detail of their lives.

It is clear that a product solving this problem needs to be of greater value. It must provide solutions to other long standing problems associated with the bed. Toward this end, I have identified two additional bedding problems, which are pervasive and relate to the bed extension issue, and two issues relating to the utility of a bed extension device.

Sitting Up in Bed

Sitting up in bed to read or watch television is a normal activity for many people and the conversion of the bed into a chair-like condition can be achieved in many ways. Hospital-type beds use a complex mechanism to alter the mattress's supports frame, bending the entire mattress to form a lounge chair like shape. Adaptations of the headboard to provide a slanted surface to support the back are a common solution. The most common type of solution to this problem is a device that sits on the bed between the individual and headboard, often a type of shaped pillow made of fabric stuffed with cotton, but also available as a book-like frame, which sits on the bed and offers adjustable positioning. Whatever the choice, ease of use is an important consideration. These answers to the sitting up in bed problem have deficiencies, which are addressed by my invention.

Convenient Storage for Bedding

While in bed it is common to decide that additional coverings are needed. This often requires that the individual get out of bed and locate the necessary blankets or quilts. Storage for these items that would allow access without getting out of bed would save effort and discomfort.

Adjustability for Different Bed Heights

Bed extensions must be exactly the same height as the bed. They need to deal with a range of elevations from about twenty inches high and up.

SUMMARY OF THE INVENTION

A single invention to address all the problems identified in the background discussion above is a bed extension-backrest chest. It is a single device to modify a bed, king, California king, queen or full, super single or single size, in 3 ways so as to (1) lengthen the sleeping surface; (2) to provide an adjustable backrest and; (3) create chest-type storage. Additionally, this is accomplished with these distinct innovations. (a) it is designed to be attached to the bed frame between the headboard and mattress (b) it is designed so-as-to allow the use of easily available pillow cases to blend it with existing bedding (c) it is adjustable for height, (d) it incorporates a double-hung lid-backrest which allows the lid to be lifted from the front for easy access to the chest and from the back to create an adjustable backrest and, (e) it has a soft, strap type lift and release system for the backrest which allows the consumer to lift or lower the backrest with one hand while in bed.

DESCRIPTION OF THE PREFERRED EMBODIMENT

A single invention to address all the problems identified in the background discussion above is a bed extension backrest chest. It is a single device to modify a bed in 3 ways so as to (a) lengthen the sleeping surface; (b) to provide an adjustable backrest and; (c) create chest-type storage.

Concept Illustration

Figure 1:
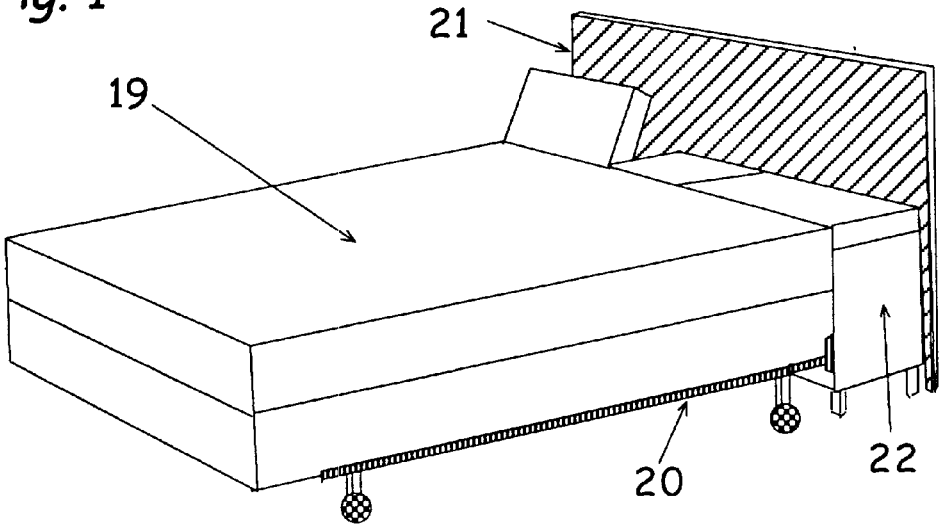
FIG. 1 is a perspective view of a conventional bed in combination with the bed extension-backrest chest as it may be used by the consumer.

In FIG. 1 the bed extension-backrest chest 22 is shown in a perspective view in combination with the mattress set 19 and frame 20 assembly as it may be used by the consumer, illustrating its position between the bed and headboard 21.

Connecting Bed, Bed Extension-backrest Chest and Headboard

In the usual circumstance the metal frame, which holds the box spring and mattress set, has a steel angle bracket with slotted holes in it, through which screws are fitted to tighten the frame and headboard together, and it is with this pre-existing system that the bed extension-backrest chest is secured to them.

Once the bed extension-backrest chest has been assembled to the proper height it is positioned between the headboard and mattress frame set of the bed. Then the four parts 19, 20, 21, 22 are attached to one another by means of the special connectors shown in FIG. 2. Each end of the chest 22 is designed to allow easy access to the connectors used for holding the chest to the headboard and frame.

Movement around the end of the bed can result in jarring collisions that leverage the force transferred to the stationary attachments at the head of the bed. It is the purpose of these special connectors to allow the frame set to move slightly from side-to-side without damaging the chest. This is accomplished by use of eye screws 23 to hold the chest to the headboard and then connecting the frame by looping a small steel cable 24 so that it passes through the two holes drilled in the chest side 25 and leg to match the holes in the frame bracket intended to attach the frame and headboard together. The cable is then returned to the chest end by passing it through the hole at the bottom of the bracket to create a means to pull the frame tightly against the bed extension-backrest chest by use of a spring 26 with one end hooked to the eye screw and the other hooked to the looped cable. The spring and cable are then connected at the other end to a turnbuckle 27, which can be easily tightened to provide a secure, yet flexible attachment for the frame to the bed extension-backrest chest.

Adjustable Height Mechanism

Figure 2:
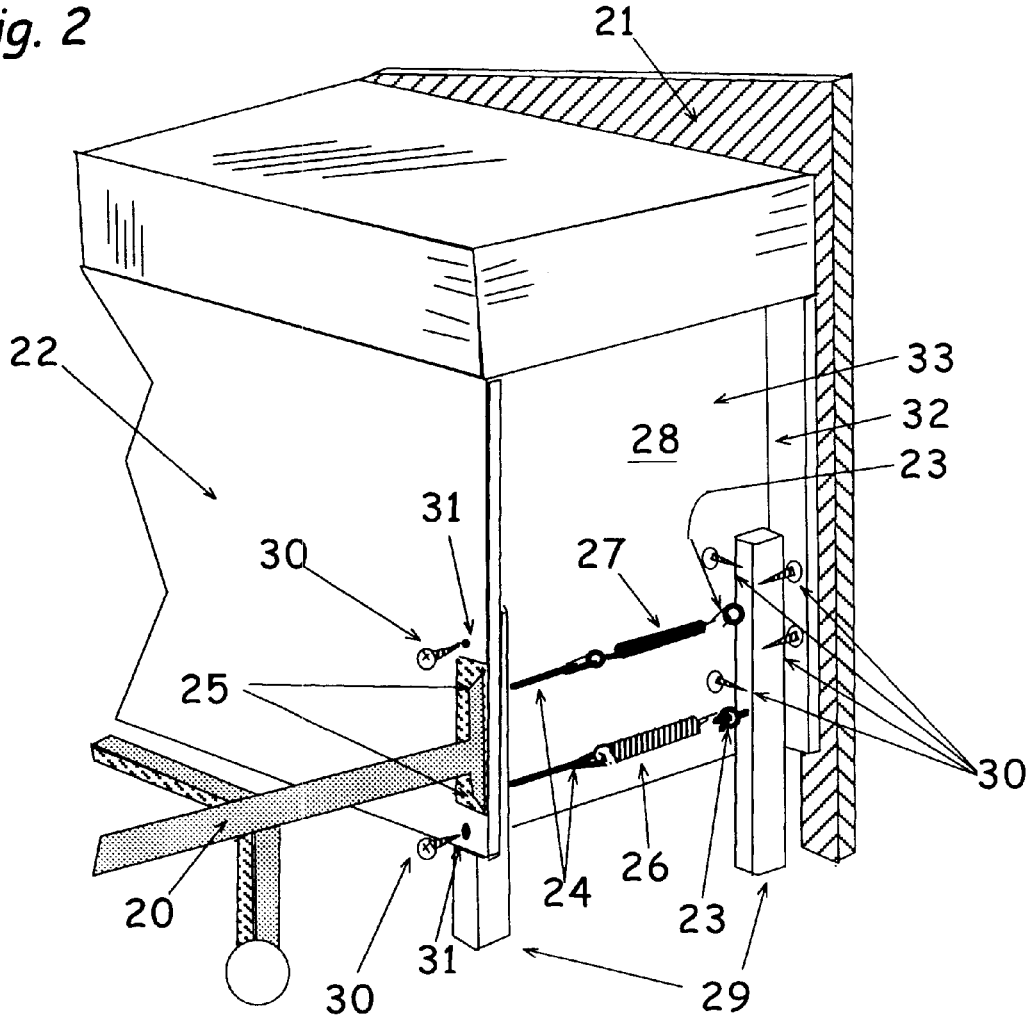
FIG. 2 shows the mechanism used to attach the bed extension-backrest chest to the mattress and headboard and also shows the method used to adjust the height.

The height of the surface of the bed varies for many reasons. Different manufactures and styles combine with consumer additions like foam pads to make bed height an individual situation. Thus a bed extension-backrest chest, must be easily adjustable for height. The method used is shown in FIG. 2. The ends of the bed extension-backrest chest are designed so that an external two sided channel 28 is formed by the side and end of the bed extension-backrest chest on all corners where a leg 29 can be attached at any desired height. This is accomplished by the use of self-tapping screws 30 which are tightened through a series of pre-drilled holes in vertical alignment 31 in both the side 32 and end 33 of the bed extension-backrest chest. This method allows precise adjustment of leg length and also provides additional strength to the corners to counter-act torsional forces that occur when pressure is applied to either side of the end of the bed.

Double Hung Chest Door and Adjustable Backrest Mechanism

Figure 3:
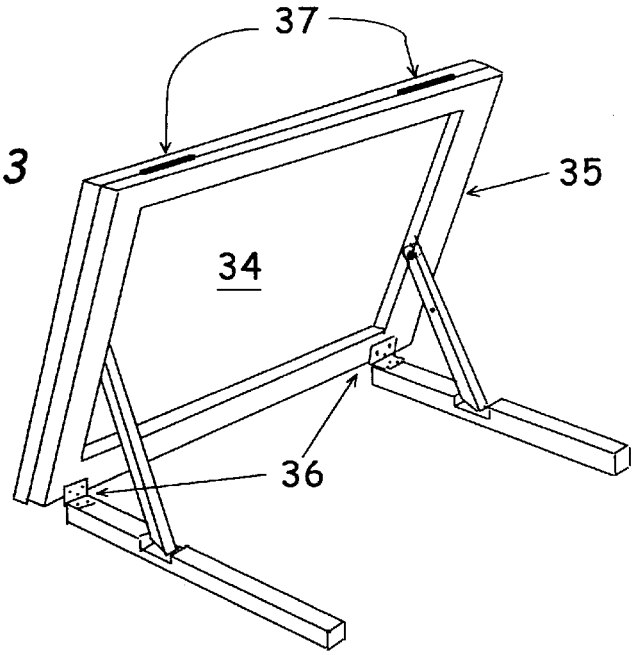
FIG. 3 details the double hinge mechanism used to allow the function of both chest access and backrest.

FIG. 3 shows the double-hung chest door-backrest assembly 34 which allows the door to be lifted from the front for easy access to the chest and from the back to create an adjustable backrest. This is done by making a frame 35 the width of the chest and length sufficient to provide comfortable support. The frame is attached with hinges 36 at the front of the chest and the door/backrest is attached with hinges 37 at the back of the frame.

One Handed Lift and Release Mechanism for Backrest

The objective of this type of lift and release system for the backrest is to allow the consumer to lift or lower the backrest with one hand while in bed.

Figure 4:
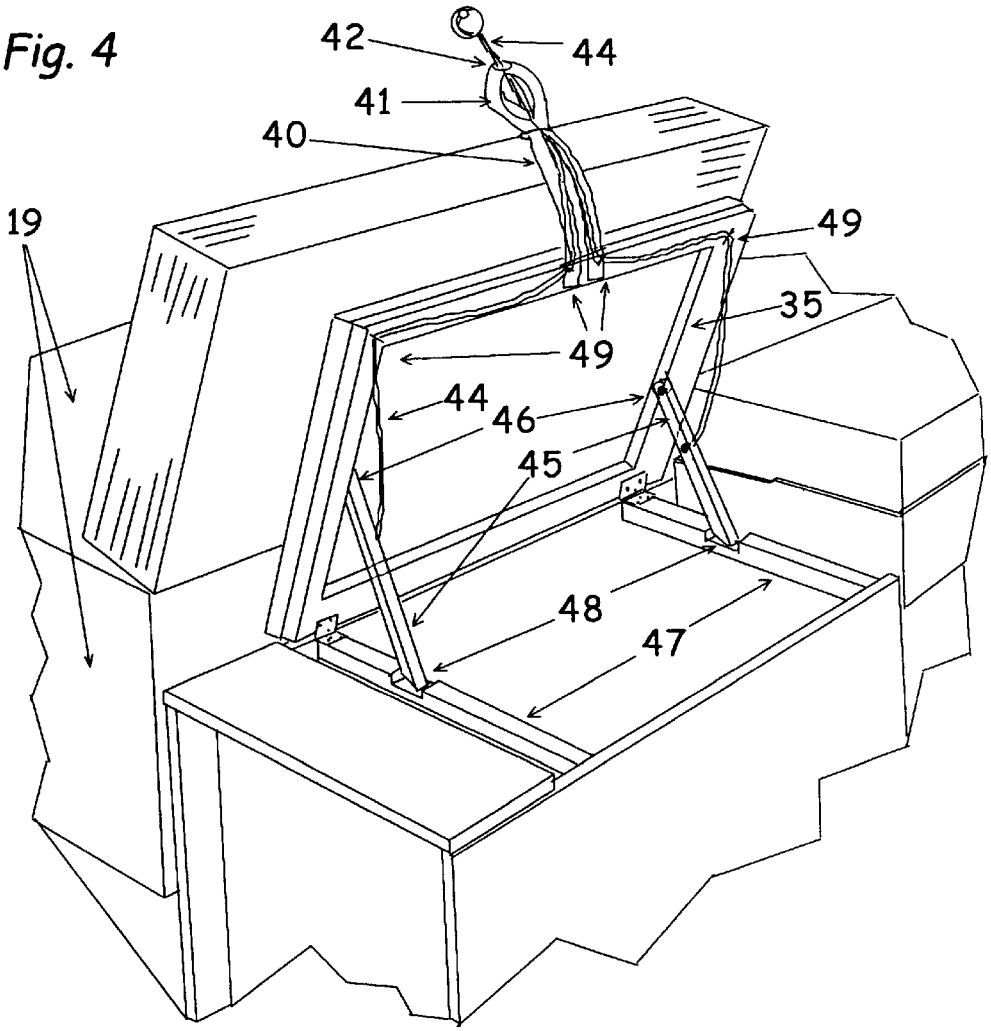
FIG. 4 is a detail of the backrest assembly showing the single-handed lift and release system.

FIG. 4 is a detail of the backrest assembly showing the single-handed lift and release system 40. It has a soft nylon strap 41 loop that extends about 6 inches above the cushion to enable easy grasping.

An eyelet 42 at the top of the strap loop 41 holds the release control cord 44 mechanism so that it can be accessed while using the strap 41 to lower the backrest.

The one-handed lift and latch system uses gravity to activate the latch. The backrest braces 45 are attached to the inside of the backrest frames 35 with screws and washers 46 so that they move freely. Thus when the backrest frame 35 is lifted, the braces 45 glide along a cross-member track 47 and drop into notches 48 located to provide an appropriate angle for sitting up in bed. The notches prevent the braces from moving back when the weight of a sitting individual is applied against the backrest.

Releasing and lowering the backrest is done by pulling on a cord 44 which is threaded from each brace up through small eye screws 49 in the backrest frame and into and through the lifting strap. The cord is attached to the brace so that a small movement of the cord results in significant movement of the braces. This allows the consumer to pull the cord so that the braces snap tightly against the backrest and then lower the backrest to a horizontal position.

I claim:

1. A storage chest, adapted to be removably attached between the body supporting portion of a bed and its headboard, comprising:

a generally rectangular chest having a pivotally openable lid, which in a partially open and pivoted position is adapted to be used as a backrest, to support the back of a user of the bed; means to removably attach the chest between the body supporting portion of the bed and the headboard; means to attach adjustable height legs to the chest;

means to support said lid in a pivoted, back supporting position; and means for lifting and lowering said lid by only one hand of a user of the bed, whereby when the chest is attached to the body supporting portion of the bed and the headboard, the chest extends the supporting portion of the bed, and is useable as a backrest and storage means.

* * * * *

UNITED STATES PATENT AND TRADEMARK OFFICE

CERTIFICATE OF CORRECTION

PATENT NO. : 6,151,738
DATED : November 28, 2000
INVENTOR(S) : Dane Michael Arr

It is certified that error appears in the above-identified patent and that said Letters Patent is hereby corrected as shown below:

Title page, Item [54] and Column 1, line 1,
Title of invention should read as follows: -- BED EXTENSION BACKREST CHEST --

Signed and Sealed this

Sixth Day of August, 2002

*Attest:*

*Attesting Officer*

JAMES E. ROGAN
*Director of the United States Patent and Trademark Office*